US009224268B2

(12) United States Patent
Aoki et al.

(10) Patent No.: US 9,224,268 B2
(45) Date of Patent: Dec. 29, 2015

(54) GAMING SYSTEM WITH PRIVACY FEATURES

(71) Applicant: WMS Gaming Inc., Waukegan, IL (US)

(72) Inventors: Dion Aoki, Chicago, IL (US); Mary Burke, Somonauk, IL (US); Patrick Gustafson, Chicago, IL (US); Joel Jaffe, Glenview, IL (US); Timothy Loose, Chicago, IL (US); Mark Pace, Palatine, IL (US); Justin Perkins, Chicago, IL (US); Dave Savage, Chicago, IL (US); Matthew Ward, Northbrook, IL (US); Tejas Shah, Schaumburg, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 9 days.

(21) Appl. No.: 13/793,271

(22) Filed: Mar. 11, 2013

(65) Prior Publication Data

US 2014/0162762 A1 Jun. 12, 2014

Related U.S. Application Data

(60) Provisional application No. 61/735,549, filed on Dec. 10, 2012.

(51) Int. Cl.
*G07F 17/32* (2006.01)

(52) U.S. Cl.
CPC ..... *G07F 17/3288* (2013.01); *G07F 17/3218* (2013.01)

(58) Field of Classification Search
CPC .. G07F 17/32; H04B 2203/5458; A63F 13/06
USPC ..... 273/146, 274, 292, 237; 463/11, 12, 13, 463/16, 18, 20, 25, 31, 39, 42, 17, 21, 27, 463/29, 36, 46; 726/26; 705/34, 44; 715/757; 725/131; 709/204
See application file for complete search history.

(56) References Cited

U.S. PATENT DOCUMENTS 4,856,787 A * 8/1989 Itkis ..... 273/237
5,919,091 A * 7/1999 Bell ..... G06Q 20/342 235/380

(Continued)

FOREIGN PATENT DOCUMENTS

WO 2007/022256 2/2007
WO 2007/089410 8/2007

(Continued)

*Primary Examiner* — Gerald Gauthier
(74) *Attorney, Agent, or Firm* — Nixon Peabody LLP

(57) ABSTRACT

A wagering game system includes a peripheral device with a peripheral device display and at least one processor configured to execute at least one application to display information on the peripheral device display. The system also includes a wagering game terminal with a terminal display configured to display a wagering game and a player-accessible interface configured to allow a player to communicatively couple the peripheral device to the wagering game terminal. The at least one application includes a wagering game application relating to the wagering game displayed on the terminal display of the wagering game terminal, and the at least one processor of the peripheral device executes the wagering application to display, on the peripheral device display, wagering game information relating to the wagering game.

21 Claims, 9 Drawing Sheets

(56) References Cited

U.S. PATENT DOCUMENTS 6,117,011 A * 9/2000 Lvov ..... G07F 17/32 463/25
6,290,603 B1 * 9/2001 Luciano, Jr. ..... 463/25
6,406,371 B1 * 6/2002 Baba et al. ..... 463/42
6,517,433 B2 2/2003 Loose et al.
6,719,631 B1 * 4/2004 Tulley et al. ..... 463/17
6,783,456 B2 * 8/2004 White ..... 463/18
6,837,793 B2 * 1/2005 McClintic ..... 463/42
6,846,238 B2 1/2005 Wells
6,932,340 B1 * 8/2005 Schaefer et al. ..... 273/146
7,107,245 B1 * 9/2006 Kowalick ..... G06Q 20/10 235/380
7,285,048 B2 * 10/2007 Karmarkar ..... G07F 17/32 463/42
7,329,186 B2 * 2/2008 Griswold ..... G07F 17/32 463/1
7,344,443 B2 * 3/2008 Yamagishi ..... 463/25
7,410,419 B2 * 8/2008 Fiden ..... 463/20
7,506,172 B2 * 3/2009 Bhakta ..... G07F 17/32 463/29
7,686,685 B2 * 3/2010 Englman et al. ..... 463/20
7,731,585 B2 * 6/2010 Okada ..... 463/20
7,785,182 B2 * 8/2010 Thomas et al. ..... 463/11
7,850,528 B2 12/2010 Wells
7,867,083 B2 * 1/2011 Wells ..... G06F 21/32 463/29
7,950,993 B2 * 5/2011 Oberberger ..... 463/16
7,976,382 B2 * 7/2011 Benbrahim ..... 463/25
8,057,303 B2 * 11/2011 Rasmussen ..... G07F 17/3218 463/16
8,075,384 B2 * 12/2011 Jones et al. ..... 463/16
8,079,904 B2 * 12/2011 Griswold ..... G07F 17/32 463/25
8,137,192 B2 3/2012 Thomas
8,147,309 B2 * 4/2012 Amirsadri et al. ..... 463/13
8,147,316 B2 * 4/2012 Arezina ..... G07F 17/3206 463/20
8,152,634 B2 4/2012 Gagner et al.
8,192,277 B2 * 6/2012 Soltys et al. ..... 463/25
8,210,942 B2 7/2012 Shimabukuro et al.
8,226,459 B2 * 7/2012 Barrett et al. ..... 463/7
8,231,455 B2 * 7/2012 Walker et al. ..... 463/25
8,251,803 B2 * 8/2012 Nelson ..... 463/27
8,272,947 B2 * 9/2012 Gagner ..... G07F 17/32 273/138.1
8,292,731 B2 * 10/2012 Collette et al. ..... 463/26
8,317,584 B2 * 11/2012 Aoki et al. ..... 463/13
8,317,597 B2 * 11/2012 Taylor ..... 463/21
8,376,837 B2 * 2/2013 Gagner et al. ..... 463/25
8,460,093 B2 * 6/2013 Jackson ..... 463/25
8,473,852 B2 * 6/2013 Russell ..... 715/757
8,512,147 B2 * 8/2013 Aoki et al. ..... 463/42
8,517,829 B2 * 8/2013 Reddy et al. ..... 463/31
8,562,419 B2 * 10/2013 Nicely ..... 463/20
8,562,427 B2 * 10/2013 Baerlocher ..... 463/25
8,574,079 B2 * 11/2013 Russell ..... 463/39
8,608,542 B2 * 12/2013 Davis et al. ..... 463/17
8,613,664 B2 * 12/2013 Anderson et al. ..... 463/31
8,613,670 B2 * 12/2013 Hartmann ..... G07F 17/32 463/11
8,622,811 B1 * 1/2014 Aoki et al. ..... 463/20
8,622,842 B2 * 1/2014 Nguyen et al. ..... 463/42
8,632,399 B2 * 1/2014 Peterson ..... 463/29
8,663,010 B2 * 3/2014 Thomas et al. ..... 463/42
8,672,746 B2 * 3/2014 Burford ..... 463/25
8,721,419 B2 * 5/2014 Aoki et al. ..... 463/13
8,758,107 B2 * 6/2014 Cole ..... 463/13
8,758,121 B2 * 6/2014 Tan ..... 463/25
8,814,656 B2 * 8/2014 Caputo ..... 463/20
8,814,661 B2 * 8/2014 Thorne et al. ..... 463/25
8,876,595 B2 * 11/2014 Nelson et al. ..... 463/29
8,888,586 B2 * 11/2014 Hsu ..... G06F 17/3251 463/29
8,909,706 B2 * 12/2014 Seligstein ..... G06Q 50/01 709/200
8,920,239 B2 * 12/2014 Reddy et al. ..... 463/31
2002/0094869 A1 * 7/2002 Harkham ..... 463/42
2003/0022719 A1 * 1/2003 Donald ..... G06Q 30/06 463/42
2003/0119575 A1 * 6/2003 Centuori et al. ..... 463/20
2004/0015423 A1 * 1/2004 Walker et al. ..... 705/34
2004/0259633 A1 * 12/2004 Gentles ..... G07F 17/32 463/29
2007/0060316 A1 * 3/2007 O'Halloran ..... 463/25
2008/0058075 A1 * 3/2008 Walker ..... G07F 17/34 463/20
2008/0214261 A1 * 9/2008 Alderucci ..... G07F 17/32 463/16
2009/0075724 A1 * 3/2009 Breeding et al. ..... 463/25
2009/0104994 A1 * 4/2009 Rybak ..... 463/42
2009/0162245 A1 6/2009 Rasmussen
2009/0176559 A1 7/2009 Buchholz et al.
2009/0176561 A1 * 7/2009 Rowe ..... 463/25
2009/0197673 A1 8/2009 Bone et al.
2009/0197684 A1 8/2009 Arezina et al.
2009/0221359 A1 * 9/2009 Adiraju et al. ..... 463/25
2009/0247256 A1 * 10/2009 Barnes, II et al. ..... 463/17
2009/0280910 A1 11/2009 Gagner et al.
2009/0298577 A1 12/2009 Gagner et al.
2010/0069160 A1 3/2010 Barrett et al.
2010/0081501 A1 4/2010 Carpenter et al.
2010/0113143 A1 5/2010 Gagner et al.
2010/0210352 A1 8/2010 Ansari et al.
2010/0210353 A1 * 8/2010 Gagner et al. ..... 463/25
2010/0222134 A1 * 9/2010 Gagner et al. ..... 463/25
2010/0234099 A1 9/2010 Rasmussen et al.
2010/0275267 A1 * 10/2010 Walker et al. ..... 726/26
2010/0304841 A1 * 12/2010 Sammon et al. ..... 463/25
2011/0053671 A1 * 3/2011 Aoki et al. ..... 463/16
2011/0070940 A1 * 3/2011 Jaffe et al. ..... 463/20
2011/0124401 A1 5/2011 Durham et al.
2011/0145883 A1 * 6/2011 Godar et al. ..... 725/131
2011/0263318 A1 10/2011 Agarwal et al.
2012/0015735 A1 1/2012 Abouchar et al.
2012/0135790 A1 * 5/2012 Powell et al. ..... 463/11
2012/0149456 A1 * 6/2012 Acres ..... 463/25
2012/0208645 A1 * 8/2012 Rodriguez et al. ..... 463/46
2012/0220353 A1 * 8/2012 Massing et al. ..... 463/16
2012/0286473 A1 * 11/2012 Nguyen ..... 273/274
2013/0072279 A1 * 3/2013 Aoki et al. ..... 463/16
2013/0137509 A1 * 5/2013 Weber ..... 463/29
2013/0137516 A1 * 5/2013 Griswold et al. ..... 463/36
2013/0140773 A1 * 6/2013 Goto ..... 273/292
2013/0178265 A1 * 7/2013 Lubin ..... 463/12
2013/0303265 A1 * 11/2013 Wilkins et al. ..... 463/25
2014/0080603 A1 * 3/2014 Gagner et al. ..... 463/31
2014/0121015 A1 * 5/2014 Massing ..... G07F 17/3211 463/33
2014/0162762 A1 * 6/2014 Aoki ..... G07F 17/3288 463/25
2014/0235327 A1 * 8/2014 Aoki ..... G07F 17/3202 463/25
2014/0315619 A1 * 10/2014 Bowers et al. ..... 463/20

FOREIGN PATENT DOCUMENTS

WO 2007/146346 12/2007
WO 2010/006277 1/2010

* cited by examiner

GAMING SYSTEM WITH PRIVACY FEATURES

CROSS-REFERENCE TO RELATED APPLICATION

This application claims the benefit of U.S. Provisional Application No. 61/735,549, filed Dec. 10, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to gaming apparatus and methods that provide privacy features.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

In general, elements on screens for wagering games (e.g., credit meters) may reveal some monetary or financial information about a player. Some players may want to keep their monetary or financial information private. Additionally, some players may not want to draw attention to the awards they receive for winning wagers. Accordingly, players may prefer to make the information provided by the credit meters at a gaming terminal less visible to others. To meet the preferences of these players, aspects of the present invention provide privacy features for displaying sensitive information on gaming terminals more discretely.

In one embodiment, a wagering game system includes a peripheral device with a peripheral device display and at least one processor configured to execute at least one application to display information on the peripheral device display. The system also includes a wagering game terminal with a terminal display configured to display a wagering game and a player-accessible interface configured to allow a player to communicatively couple the peripheral device to the wagering game terminal. The at least one application includes a wagering game application relating to the wagering game displayed on the terminal display of the wagering game terminal, and the at least one processor of the peripheral device executes the wagering application to display, on the peripheral device display, wagering game information relating to the wagering game. The terminal display and the peripheral device display may combine to display the wagering game.

In another embodiment, a wagering game terminal includes a terminal display configured to display a wagering game. The wagering game terminal also includes a player-accessible interface configured to allow a player to communicatively couple a peripheral device to the wagering game terminal. The peripheral device includes a peripheral device display and at least one processor configured to execute a wagering game application relating to the wagering game and to display, on the peripheral device display, wagering game information relating to the wagering game. In response to the execution of the wagering game application on the peripheral device, the terminal display displays the wagering game in combination with the peripheral device displaying the wagering game information.

In the embodiments above, the at least one processor of the peripheral device may execute the wagering game application to display, on the peripheral device display, at least one of credit information, wager information, award information, monetary information, and player information.

The wagering game information may include private information that is restricted from being displayed on the terminal display, and the private information includes at least one of credit information, wager information, award information, monetary information, and player information.

The peripheral device may include an input interface configured to receive instructions from the player to customize the wagering game, and the terminal display displays the wagering game according to the instructions. In response to the instructions, the terminal display may be restricted from displaying at least one of credit information, award information, monetary information, and player information.

The wagering game application may include a player's account application, and the at least one processor of the peripheral device executes the player's account application to log the player into the wagering game terminal under a player's account.

The wagering game application may include a player's account application, and the at least one processor of the peripheral device executes the player's account application to store and display information relating to another wagering game that provides an award based on a plurality of outcomes from one or more wagering games.

The wagering game application may include a money transfer application that is electronically coupled to a monetary account, and the at least one processor of the peripheral device executes the money transfer application to transfer money between the wagering game terminal and the monetary account, the wagering game terminal receiving portions of the money from the player for wagers for the wagering game or awarding other portions of the money to the player for outcomes of the wagering game.

The peripheral device may further include at least one of a tactile output device and an audio output device, and the at least one processor of the peripheral device executes the wagering application to further provide the wagering game information via at least one of the tactile output device and the audio output device, the terminal display displaying the wagering game to correspond with the peripheral device further providing the wagering game information via at least one of the tactile output device and the audio output device.

The interface may be a docking station that is configured to receive the peripheral device and establish communications between the peripheral device and the wagering game terminal. The peripheral device, when received by the docking station, may provide a secondary display for the wagering game at the bottom of the terminal display.

The interface may be a wireless interface.

Additional aspects of the invention will be apparent to those of ordinary skill in the art in view of the detailed description of various embodiments, which is made with reference to the drawings, a brief description of which is provided below.

Figure 1:
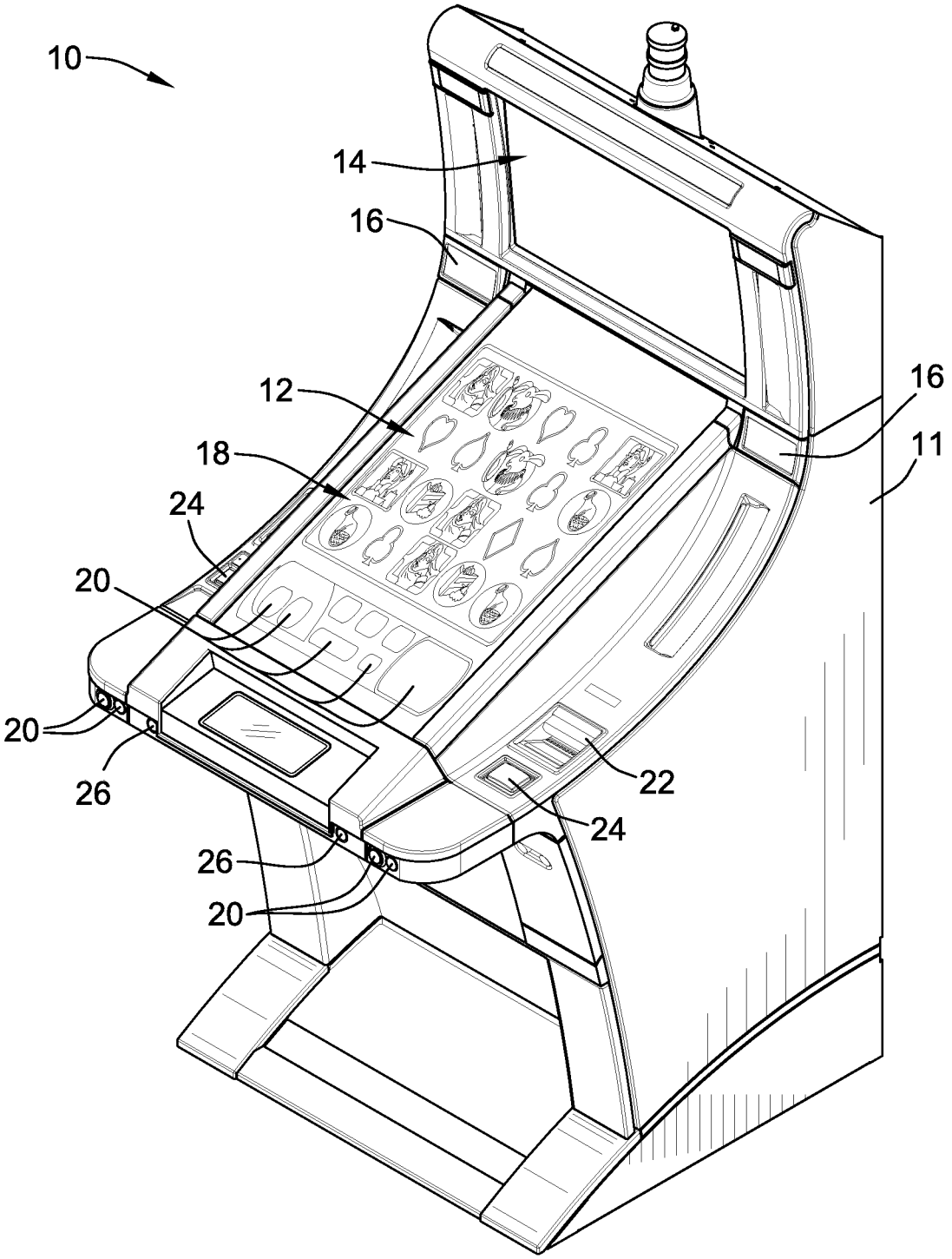
FIG. 1 illustrates an example free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games. In some cases, the use of virtual currency issued by a gaming establishment, wagering game manufacturer, etc., may foster loyalty to that gaming establishment, wagering game manufacturer, etc., because the virtual currency is non-fungible and limited to uses associated with the particular institutions. In further embodiments, the wagering game may involve the awarding of non-cash awards, coupons, etc. In yet further embodiments, the wagering game may involve a mixture of real, virtual money, and/or non-cash awards.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
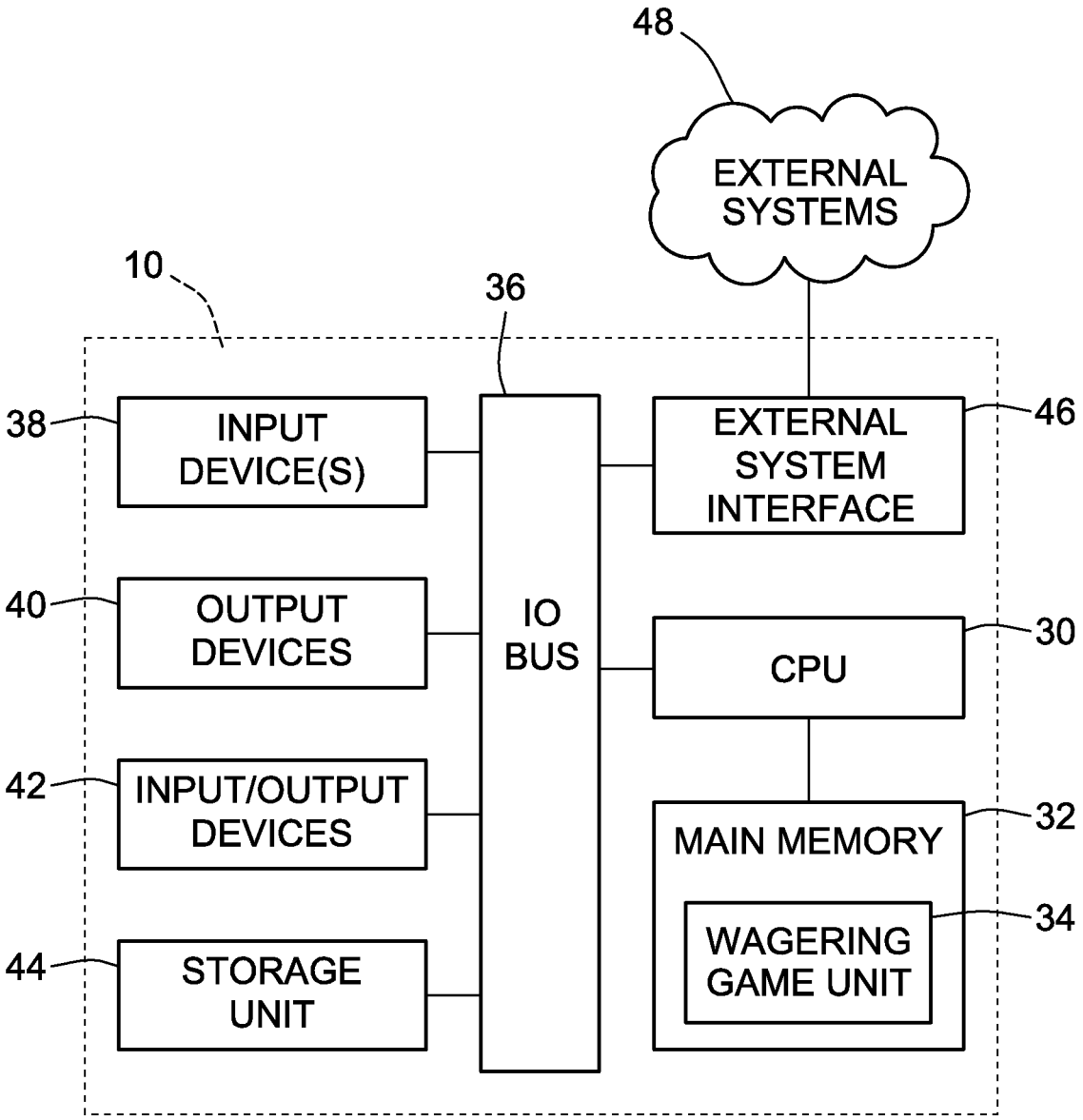
FIG. 2 illustrates a gaming system according to an embodiment of the present invention.

Turning now to FIG. 2, there is shown a block diagram of the gaming terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., BLUETOOTH®, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
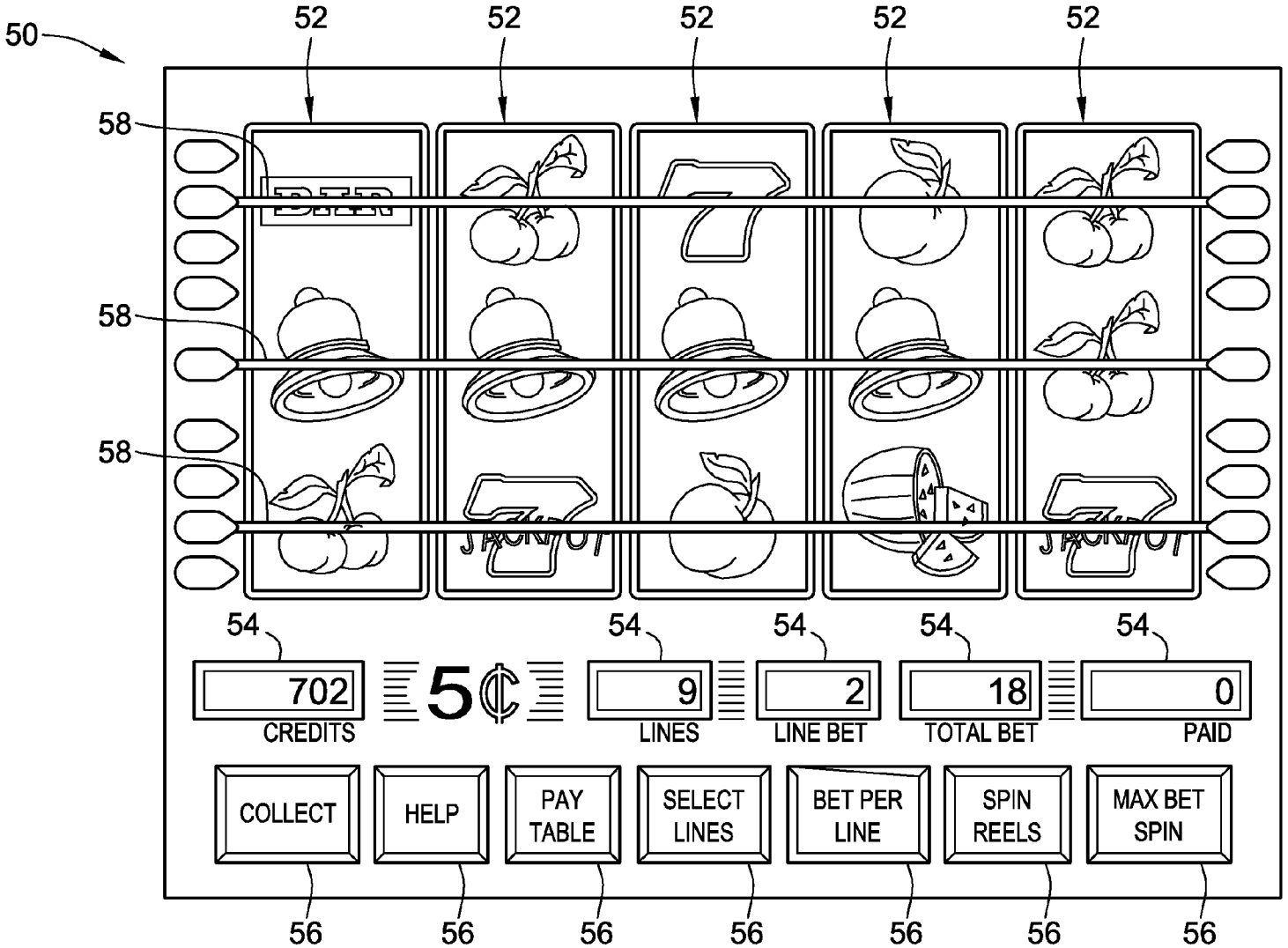
FIG. 3 illustrates an example reel-based game screen of a wagering game displayed on a gaming terminal, according to an embodiment of the present invention.

Referring now to FIG. 3, there is illustrated an image of a game screen 50, which may be displayed, for example, on the primary display area 12 or the secondary display area 14 to present the result of a reel-based wagering game. The reel-based game screen 50 portrays a plurality of simulated symbol-bearing reels 52. Alternatively or additionally, the game screen 50 portrays a plurality of mechanical reels or other video or mechanical presentation consistent with the game format and theme. The game screen 50 also displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU 30 operate(s) to execute a wagering game program causing the primary display area 12 or the secondary display area 14 to display the wagering game.

In response to receiving a wager, the reels 52, as shown on the game screen 50, are rotated and stopped to place symbols on the reels in visual association, for example, with paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

As described above, the game screen 50 displays one or more game-session credit meters 54. As shown in FIG. 3, the credit meters 54 indicate the number of total credits available for making wagers, the number of paylines selected for the current wager, the number of credits wagered for each selected payline in the current wager, the number of total credits currently wagered, and the number of credits awarded for the current wager. When the game screen 50 is shown on the primary display 12 or the secondary display 14, the credit meters 54 may be visible to anyone in the area around the gaming terminal 10. In other words, the information shown in the credit meters 54 can also be seen by people who are not playing the wagering game on the gaming terminal 10.

The number of total credits available for making wagers indicates how much the player has put into the gaming terminal 10 for wagers and/or how much the player has won or lost from playing the wagering game. If the number of total credits available is redeemable for money, the number of total credits indicates how much money the player currently possesses. In addition, the number credits currently wagered may indicate how much the player can afford to wager. In general, the credit meters 54 reveal some monetary or financial information about the player. Some players may want to keep their monetary or financial information private. Additionally, some players may not want to draw attention to the awards they receive for winning wagers. Accordingly, players may prefer to make the information provided by the credit meters at a gaming terminal less visible to others. To meet the preferences of these players, aspects of the present invention provide privacy features for displaying sensitive information on gaming terminals more discretely.

Figure 4A:
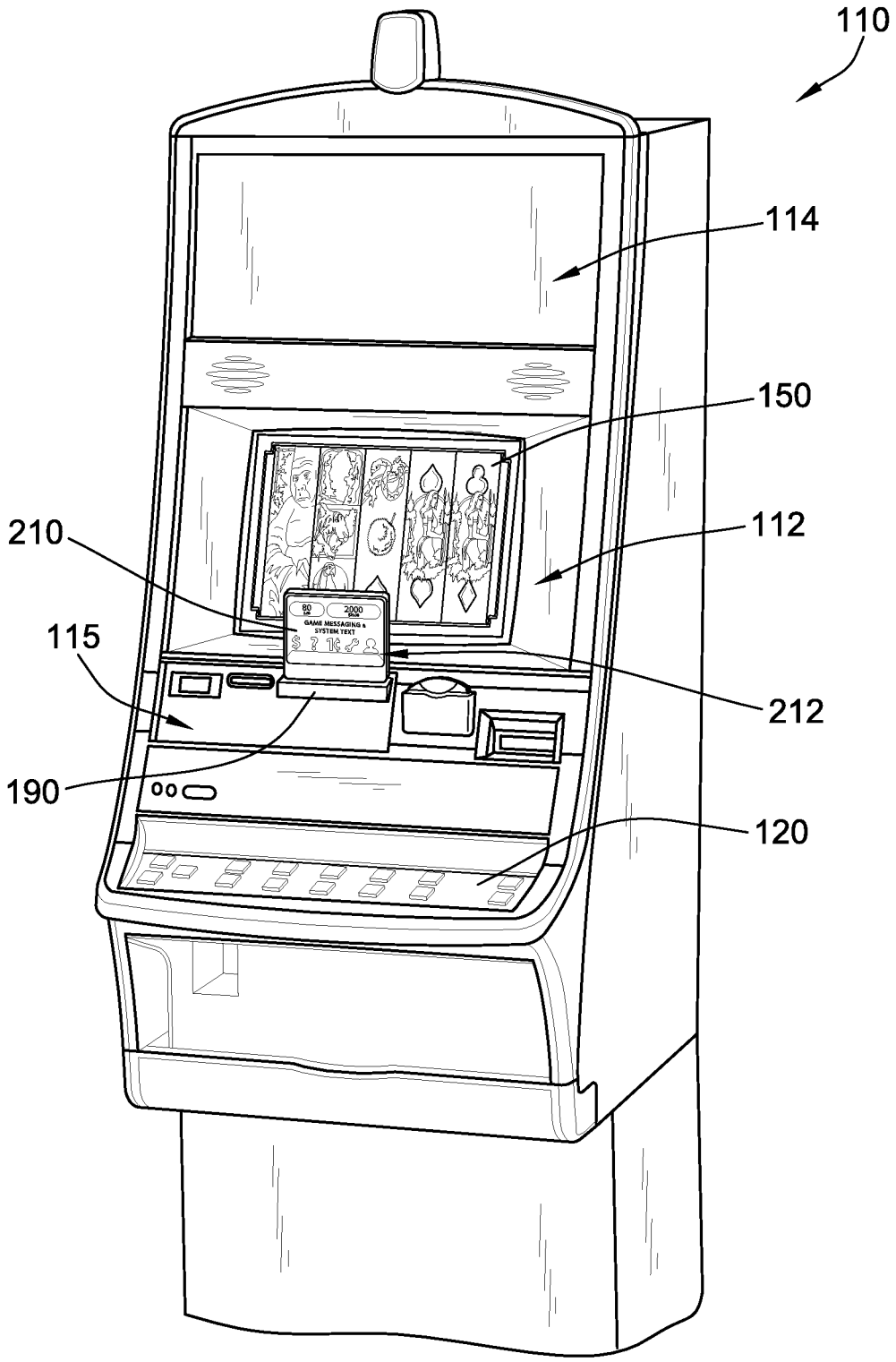
FIGS. 4A-B illustrates an example gaming terminal that includes a docking interface for receiving and communicating with a peripheral device, according to aspects of the present invention.
Figure 4B:
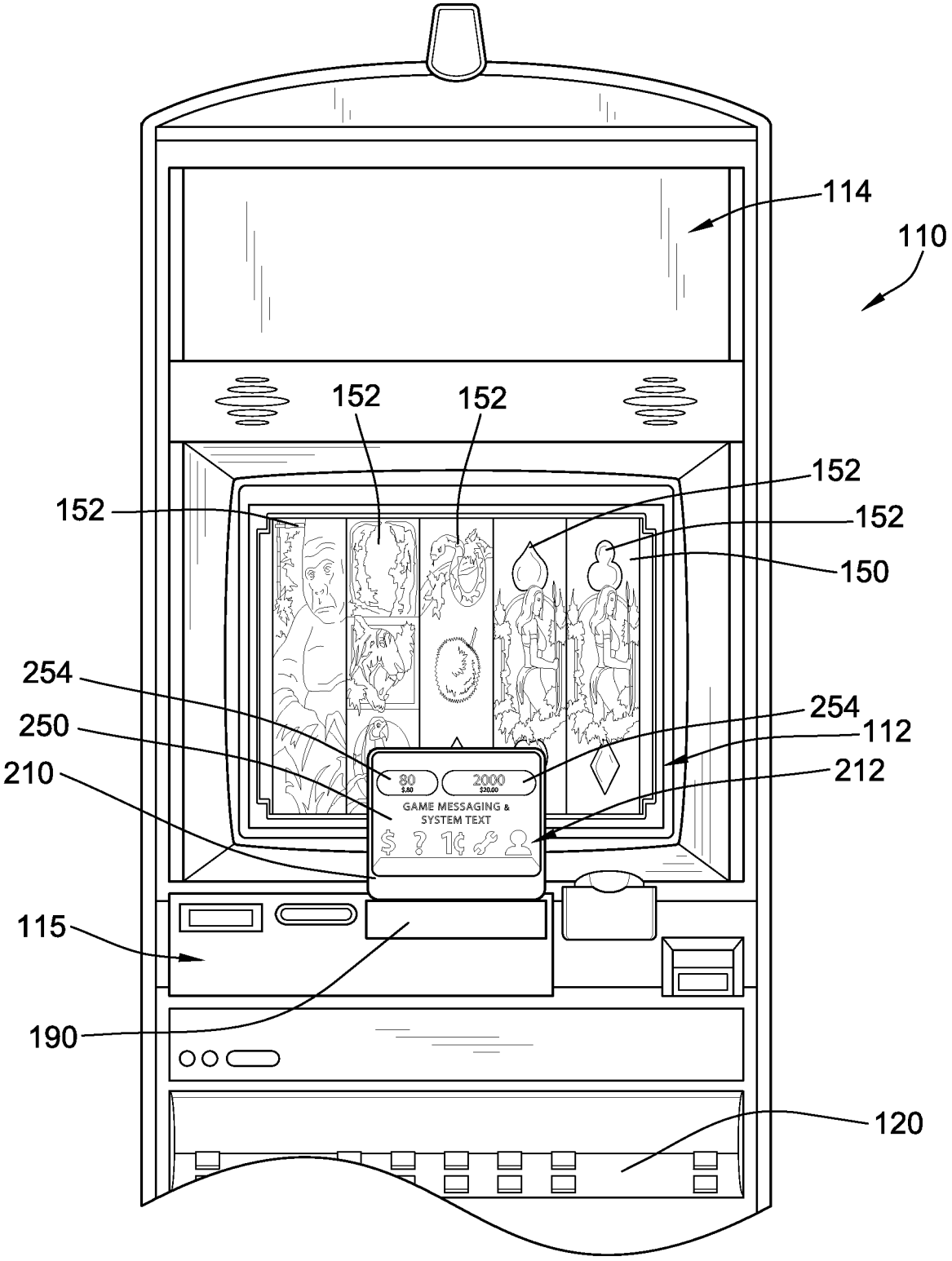

Referring to FIGS. 4A-B, an example gaming terminal 110 with privacy features is illustrated. Among other features, the gaming terminal 110 includes a display area 112 for displaying a game screen 150 of a wagering game and a button panel with buttons (and/or other input devices) 120 that receive input from the player for operating the gaming terminal 110 and playing the wagering game. Unlike the gaming terminal 10 described above, however, the gaming terminal 110 includes a docking interface 190 for receiving a peripheral device 210, such as a tablet computer (e.g., APPLE® iPAD®), smart phone (e.g., APPLE® iPHONE®), or other portable computing device. The docking interface 190 is compatible with a connector provided by the peripheral device 210 (e.g., conventional APPLE® iPAD® or APPLE® iPHONE® connector). In addition to establishing communications between the gaming terminal 110 and the peripheral device 210, the docking interface 190 in some cases mat also supply electrical power to the peripheral device 210 to recharge a battery in the peripheral device 210.

Figure 4C:
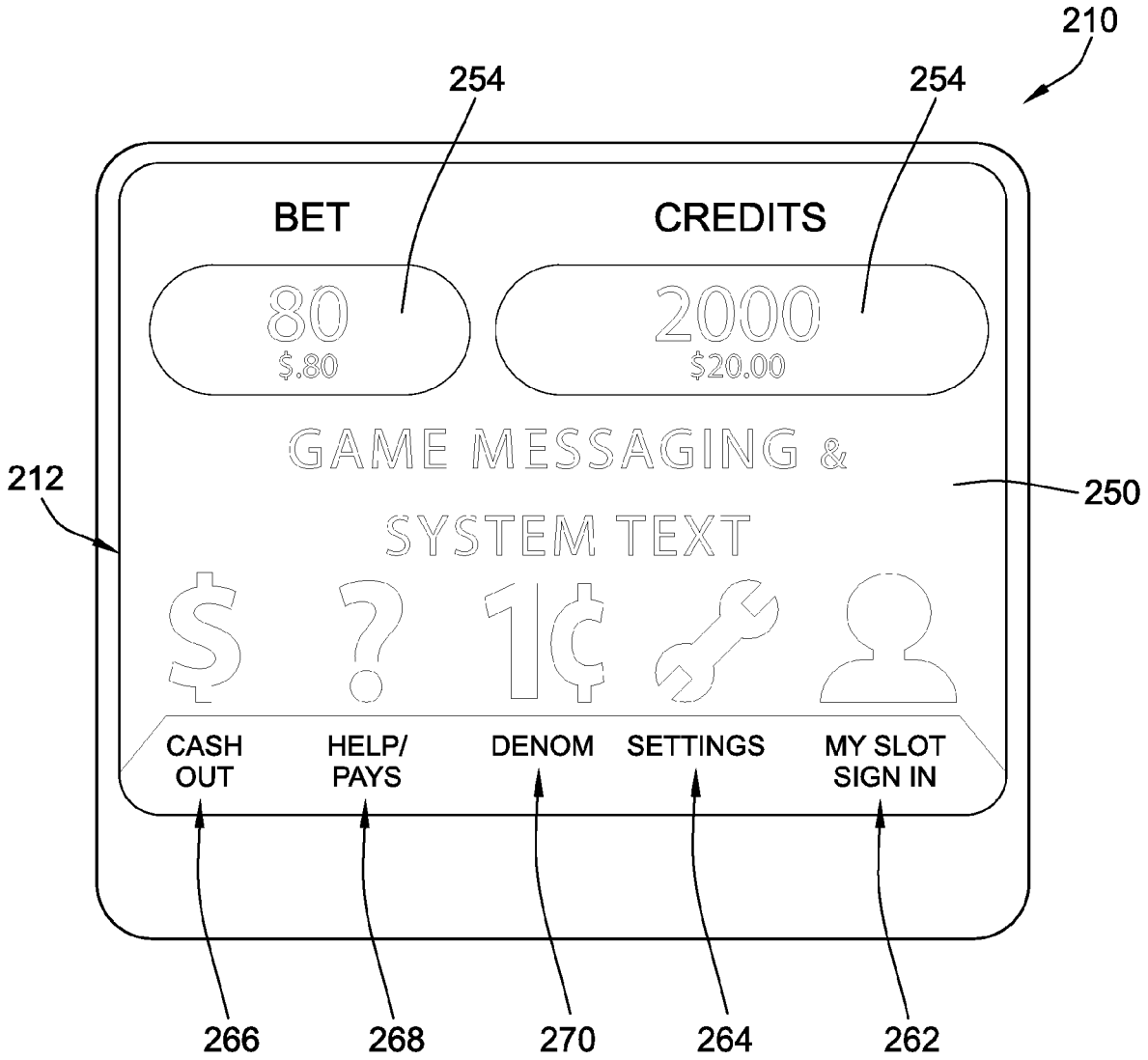
FIG. 4C illustrates the peripheral device employed with the example gaming terminal of FIGS. 4A-B, according to aspects of the present invention.

As shown in FIG. 4A, the docking interface 190 is disposed on a front panel 115 of the gaming terminal 110, between the buttons 120 and the display 112. FIG. 4B illustrates how the display 212 of the peripheral device 210 and the display area 112 of the gaming terminal 100 combine to present information relating to a wagering game. The terminal display 112 displays the game screen 150 with graphical elements, e.g., reels 152, which indicate the outcome of the wagering game. Meanwhile, the peripheral device 210 displays credit meters 254 corresponding to the wagering game shown on the terminal display 112. FIG. 4C illustrates the peripheral device 210 separate from the gaming terminal 110 and more clearly shows the credit meters 254. Although the credit meters in FIG. 4C only provide the number of total credits available for wagers and the number of credits currently being wagered, it is understood that the peripheral device 210 may display any combination of information relating to credits, wagers, payouts, etc. In some cases, all such information may be completely removed from the displays 112, 114 of the gaming terminal 110 and displayed exclusively on the peripheral device 210. In other cases, the credit meters showing numerical information may be displayed on the peripheral device 210, while the displays 112 and/or 114 may display non-numerical indicators for some information relating to credits, wagers, payouts, etc.

The docking interface 190 positions the peripheral device 210 away from the terminal display 112 and closer to the player standing in front of the gaming terminal 110. As such, the player's body helps to block others from easily viewing the peripheral device display 212. In addition, the peripheral device display 212 is generally smaller than the primary and secondary displays 112 and 114 of the gaming terminal 110, so the information displayed by the peripheral device 212 is less visible to others. For example, the peripheral display device 212 may be approximately between 5 inches and 9 inches. Furthermore, the peripheral device display 212 can employ a font size that makes the credit meters 254 more difficult for others to see. Based on the position and orientation of the peripheral device 210, the size of the peripheral device display 212, and how the information is displayed on the peripheral device display 212, the peripheral device display 212 displays information more discretely than the terminal display 112.

Figure 5:
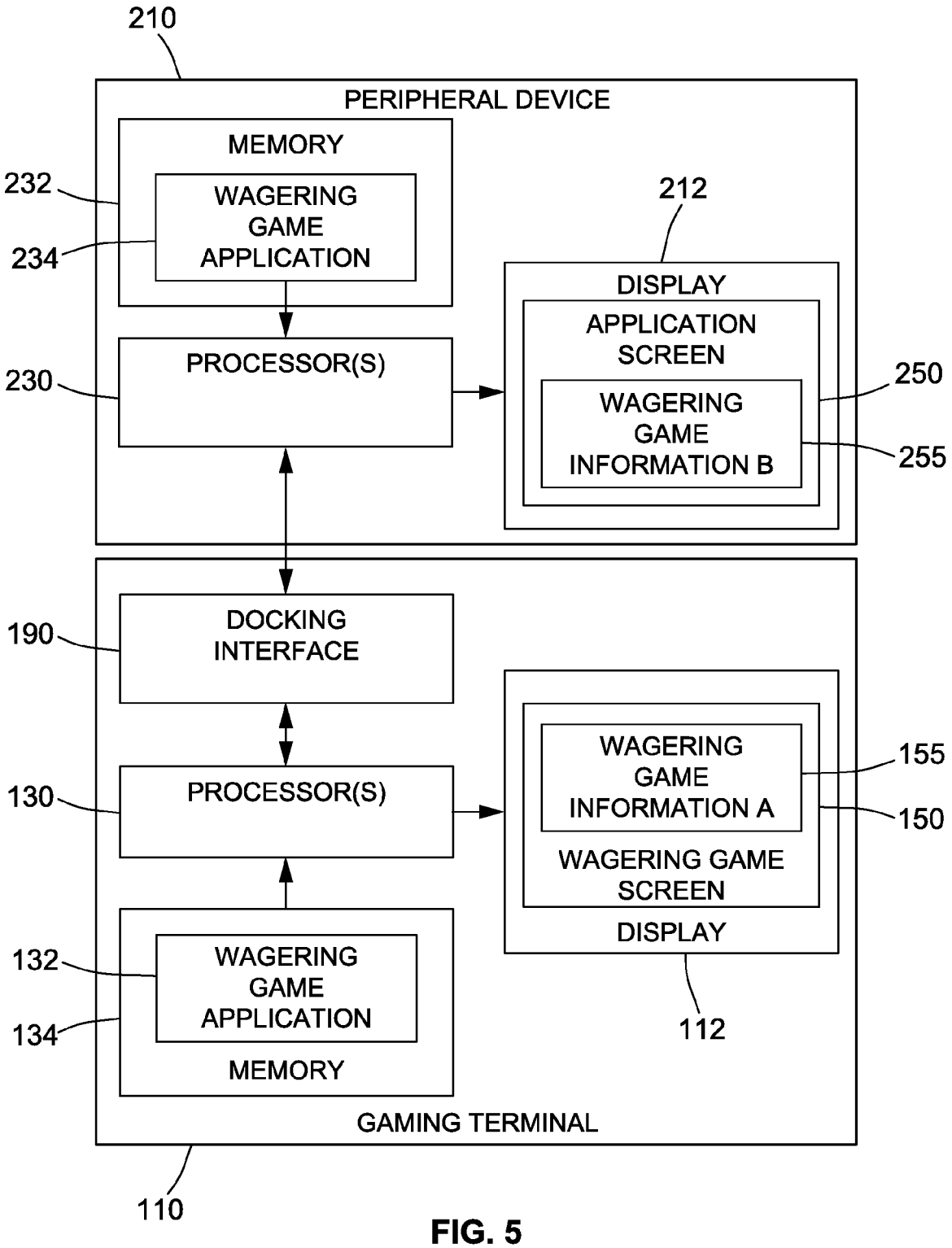
FIG. 5 illustrates an example combined operation of the gaming terminal and the peripheral device, according to aspects of the present invention.

FIG. 5 illustrates example aspects of the combined operation of the gaming terminal 110 and the peripheral device 210. As shown in FIG. 5, the peripheral device 210 includes at least one processor 230 and memory (computer-readable storage media) 232 that stores at least one application as computer-executable instructions. In particular, the at least one processor 230 executes a wagering game application 234 to display, on the peripheral device display 212, information relating to the wagering game being played on the gaming terminal 110. To coordinate the display of information between the peripheral device 210 and the gaming terminal 110, the at least one processor 230 communicates with the gaming terminal 110 via the docking interface 190.

In some embodiments, the wagering game application 234 can only be employed with a specific type of wagering game. As such, the player may be required to install a plurality of wagering game applications to use the peripheral device 210 with a variety of types of wagering games.

In other embodiments, the wagering game application 234 is a general application that can be employed with a variety of wagering games associated, for example, with a gaming establishment or a gaming terminal manufacturer. Advantageously, in such embodiments, the player is only required to install a single wagering game application to use the peripheral device 210 with a variety of types of wagering games.

The wagering game application 234 itself and updates to the application 234 may be downloaded, for example, from a conventional online application store or from a specific online resource provided by the gaming establishment or a gaming terminal manufacturer. In alternative embodiments, the wagering game application 234 does not provide a specially developed interface for the application screen 250; instead, the wagering game application 234 may use a standard web browser provided by the peripheral device 210 as an interface. For example, the wagering game application 234 may be a Java-based application that runs through a standard web browser provided by the peripheral device 210.

Similar to the gaming terminal 10 shown in FIG. 2, the gaming terminal 110 includes at least one processor 130 that executes a wagering game unit 134 stored on a memory 132. The player operates or interacts with the wagering game using the input devices, etc., on the gaming terminal 110 as described above. In response, the gaming terminal 110 displays information 155 and visual elements (e.g., reels) relating to the wagering game on the wagering game screen 150 via the display area 112. Rather than displaying all wagering game information on the display area 112, however, the gaming terminal 110 sends certain other information 255 to the peripheral device 210 via the docking interface 190. The wagering game application 234 then presents the information 255 on an application screen 250 on the peripheral device display 212. Accordingly, the gaming terminal 110 and the peripheral device 210 combine to provide the player with information for playing the wagering game. In particular, the wagering game application 234 may display any type of information 255, e.g., credit information, wager information, award information, monetary information, player information, etc., that the player may want to remain less visible when playing a wagering game on the gaming terminal 110. In general, the gaming machine 110 may communicate any information or visual elements associated with the wagering game for display on the peripheral device 210.

To establish communications between the gaming terminal 110 and the peripheral device 210, the player may log into the gaming terminal 110 through a login feature 262 provided by the wagering game application 234. As shown in FIG. 4C, the wagering game application 234 displays an example selectable icon for the login feature 262 (labeled "MY SLOT SIGN IN") on the application screen 250. The player selects the login feature 262 from the screen 250 to initiate a login process, which for example provides data entry fields that receive username and password information from the player. The peripheral device 210 communicates this login information to the gaming terminal 110, which can then permit the player to use the peripheral device 210 with the gaming terminal 110. In some embodiments, the login information may be conveniently stored by the wagering game application 234 after initial entry, so that the player is automatically logged into the gaming terminal 110 when it detects that the docking interface 190 has received the peripheral device 210. By using the peripheral device 210 to log into the gaming terminal 110, personal information, such as the player's name, may be discretely shown on the peripheral device 210, rather than the gaming terminal 110.

In some embodiments, the login feature 264 may be tied to a general player's account in an account-based gaming system. For example, the login feature 264 may be associated with a player loyalty program with a gaming institution, where the peripheral device 210 effectively acts as a player's card when it is connected with the gaming terminal 110. The wagering game application 234 may discretely show any information associated with the player's account on the peripheral device 210.

In addition to tracking loyalty points for the player's account, the wagering game application 234 may be used for other gaming features that are uniquely tied to the individual player and that maintain the tie with the player across any number of wagering game sessions. For example, the wagering game application 234 may track a personal progressive award. The personal progressive award is similar in many respects to a conventional progressive award, but the personal progressive award only grows in response to the individual player's activity and is only awarded to the individual player when a predetermined award occurs. The wagering game application 234 discretely displays information (e.g., an award meter) relating to the personal progressive award. In some cases, the information relating to personal progressive award is maintained centrally by an account based wagering system, which the wagering game application 234 accesses by logging through the gaming terminal 110. In other cases, wagering game application 234 maintains the information locally on the peripheral device 210.

In another example, to encourage a player to keep playing at the gaming terminal 110, the player may accumulate some time-based benefit, e.g., airline miles, extra loyalty points, etc., during a single gaming session. The more time the player remains at the gaming terminal 110, the greater benefit that the player earns. The wagering game application 234 may discretely display information (e.g., a benefit meter) relating to the benefit accumulated. In some cases, the information relating to the benefit is maintained centrally by an account based wagering system, which the wagering game application 234 accesses by logging through the gaming terminal 110. In other cases, wagering game application 234 maintains the information locally on the peripheral device 210.

In addition, the wagering game application 234 may provide a customization tool 264 that allows the player to instruct the gaming terminal 110 what information should be displayed on the terminal display 112 and what information should be displayed on the peripheral device display 212. As shown in FIG. 4C, the wagering game application 234 displays an example selectable icon for the customization tool 264 (labeled "SETTINGS") on the application screen 250. For example, with the tool 264, the player may customize the wagering game to display, on the peripheral device display 212, credit meters 254 that provide the number of total credits available for wagers and credit and the number of credits currently being wagered.

The customization tool 264 may also allow the player to customize other aspects of the wagering game. For example, as described above, some players may not want to draw attention to the awards they receive for winning wagers. As such, the player may employ the customization tool 264 to turn off, or reduce, any audio and/or visual feedback from the gaming terminal 110 signaling a winning outcome and/or payout. Indeed, using the customization tool 264, the player may elect to use the peripheral device 210, rather than the gaming terminal 110, to receive audio and/or visual feedback signaling a winning outcome and/or payout. Any audio feedback from the peripheral device 200 can be discretely communicated to the player through speakers at a reduced volume or through headphones. Furthermore, the player may additionally use the peripheral device 200 to provide tactile feedback, e.g., vibration, to signal a winning outcome and/or award. Accordingly, the customization tool 264 allows the player to determine how he/she is alerted with winning outcomes/awards.

In some cases, suppression of audio and/or visual feedback from the gaming terminal 110 may depend on a threshold set for an award. The threshold may be set by the player and/or the gaming establishment. If the award is less than the threshold, the gaming terminal 110 provides conventional audio and/or visual feedback. Otherwise, the peripheral device 210 discretely signals the winning outcome/award. The threshold allows the gaming establishment to generate interest and excitement by showing other players that the gaming terminal 110 is producing winning outcomes, while also accommodating the player's desire for privacy when winning a large award. In general, the wagering game application 234 allows the player to configure the behavior of the gaming terminal 110 for high award wins and other events that may draw attention from others and make them aware of a significant change in the player's monetary status.

Alternatively or additionally, the customization tool 264 may allow the player to set other types of alerts on the peripheral device 210. For example, the wagering game application 234 may be configured to provide audio (e.g., beep) or tactile (e.g., vibrate) alerts when the player's credit limit reaches a high and/or low limit, thereby notifying the player to transfer money to or from the gaming terminal 110.

Using the customization tool 264, the player may customize some of the content displayed by the primary wagering game screen 150 of the gaming terminal 110 and/or the application screen 250 of the peripheral device 210. In some embodiments, the player may select a particular theme for the wagering game. For example, the player may select a theme where reel symbols correspond to characters in a movie or book. In other embodiments, the player may select a particular visual background/wallpaper, color scheme, font scheme, etc., for the wagering game screens 150 and/or 250. Furthermore, the player may select a celebration theme (including audio, visual, and/or tactile feedback) for winning outcomes/awards communicated by the peripheral device 210.

In some cases, the customization tool 264 may provide a plurality of customization options from which the player may select. In other cases, the customization tool 264 may allow the player to develop his/her own customization options. For example, the player may be permitted to import a photograph taken with the peripheral device 210 into the wagering game application 234 and the photographed image may be used for some aspect of the wagering game screen 150 and/or 250, e.g., a reel symbol, visual background/wallpaper, etc.

Advantageously, the customization tool 264 may be able to save the player's selections and preferences, so that they can be recalled and reapplied when the peripheral device 210 is coupled to the same or other gaming terminal. The portability of the peripheral device 210 allows the player to enjoy a customized gaming experience even when playing different gaming terminals at different times.

The wagering game application 234 may also provide a money transfer feature 266 that allows the player to manage the process for cashing out from the gaming terminal 110. (In alternative embodiments, the peripheral device 210 only displays monetary information and does not handle any transfer of money.) As shown in FIG. 4C, the wagering game application 234 displays a selectable icon for the money transfer function 266 (labeled "CASH OUT") on the application screen 250. In some embodiments, the money transfer function 266 may function in a manner similar to a button on the gaming terminal for cashing out (e.g., "COLLECT" button shown in FIG. 3). Because the player's operation of the peripheral device 210 is less visible, the player can discretely cash out from the gaming terminal 110 through the money transfer function 266 on the peripheral device 110.

In some embodiments, the money transfer function 266 provides further privacy by allowing the cash out to occur through the peripheral device 210. In other words, the cash out (in the form of cash, redeemable coupon, etc.) does not occur physically through a device on the gaming terminal 110. Instead, the gaming machine 110 communicates the cash out information to the peripheral device 210, which the player uses to handle the remaining process of cashing out. In some cases, the award may be recorded on the peripheral device 210, which can then be subsequently presented, for example, to a cashier at the gaming establishment to redeem the award. For example, the money transfer feature 266 may record the award as an image, such as a UPC barcode or a matrix barcode (e.g., Quick Response (QR) Code), on the peripheral device 210. The image can then be subsequently scanned or otherwise evaluated for redemption. In some cases, other gaming machines may be configured to receive money, credits, etc. associated with the award recorded on the peripheral device 210, i.e., the award is used on other gaming terminals by transferring the award from the peripheral device 210.

In other cases, the peripheral device 210 may be able to communicate over a network, e.g., via a cellular or wi-fi wireless network, to access a monetary account for the player. The monetary account may reside at a financial institution or any other system, including, for example, an account system maintained by a gaming establishment. Accordingly, the money transfer feature 266 can directly deposit money from the gaming machine 110 to the player's monetary account when the player cashes out.

In further embodiments, the money transfer function 266 may also allow the player to withdraw money directly from the monetary account to make wagers on the gaming terminal 110. Because the player's operation of the peripheral device 210 is less visible, the player can transfer money electronically to and from the gaming machine 110 via the peripheral device 210 more discretely. For example, the player does not have to put currency physically into the gaming machine 110, an act that is more easily witnessed by others.

The wagering game application 234 may also provide a help feature 268 that allows the player to obtain information about aspects of the wagering game, the gaming terminal 110, and/or the wagering game application 234 itself As shown in FIG. 4C, the wagering game application 234 displays a selectable icon for the help feature 268 (labeled "HELP/PAYS") on the application screen 250. The information available through the help feature 268 may include an organized list of help topics, searchable help text, answers to a list of frequently asked questions, a list of tips and hints, demonstrations, simulations, etc. The information may be presented in audio and/or visual format. In addition, the help feature 268 may also provide information on the awards paid out by the wagering game, e.g., a paytable. In some wagering games, the paytable may change according to the amount wagered as well as the occurrence of other events in the wagering game. The player may prefer to keep the sizes of possible awards less visible, particularly if they may indicate the size of the player's wagers. Accordingly, the wagering game application 234 may also be employed to discretely display award information for the wagering game.

In addition to the login feature 262, the customization tool 264, the money transfer feature 266, and the help feature 268, the wagering game application 234 may provide other features. In some cases, the wagering game application 234 may allow the peripheral device 210 to act as a button panel for operating aspects of the gaming terminal 110 and/or playing the wagering game. For example, as shown in FIG. 4C, the wagering game application 234 displays a denomination icon 270 (labeled "DENOM") on the application screen 250. In some embodiments, the denomination icon 270 allows the player to select and/or display the denomination for the wagers placed for the wagering game. The denomination indicates the level of wagers placed by the player, and as such, the player may prefer the denomination to be discretely selected and/or displayed on the peripheral device 210, rather than the gaming terminal 110.

Like the money transfer feature 266, other features of the wagering game application 234 may access network communications available through the peripheral device 210. For example, the wagering game application 234 may communicate with sites on the Internet. In particular, the wagering game application 234 may communicate with social media sites (e.g., FACEBOOK®), multimedia posting sites (e.g., YOUTUBE®), electronic mail systems (e.g., GMAIL®). While the player may want not want to attract attention from the public while playing a wagering game at the gaming terminal 110, the player can selectively choose to share some aspect of the gaming experience with family and friends over the Internet. For instance, when the gaming terminal 110 communicates a winning outcome/award to the peripheral device 110, the wagering game application 234 may present audiovisual content that alerts the player about the winning outcome/award. The wagering game application 234 may save this content and allow the player to send or post the content over the Internet to share with selected people.

In further embodiments, the wagering game application 234 may provide online access to other content, services, etc. For example, the player may be able to access hospitality services in association with the gaming establishment.

In general, FIGS. 4A-C illustrate a peripheral device 210 that is employed in combination with the gaming terminal 110. The peripheral device 210 executes an application 234 that relates to the wagering game of the gaming terminal 110. The wagering game application 234 allows selected information relating to the wagering game to be displayed on the peripheral device 110. To accommodate the privacy preferences of the player, the peripheral device 110 may discretely display credit information, wager information, award information, monetary information, and/or player information. However, it is contemplated that other information may be selectively shown on the peripheral device 210, rather than the gaming terminal 110.

Advantageously, the features provided by aspects of the present invention attract players who prefer to keep their monetary or financial information private. Moreover, such features may encourage players to put more money into gaming terminals and place larger wagers because this information is not visible to others. In addition, to attract players, the wagering game application 234 can provide other features, particularly to customize and personalize aspects of the gaming experience.

As shown in the FIGS. 4A-C, the gaming machine 110 is compatible with a tablet computer. In general, people are employing tablet computers for a growing number and variety of applications. Indeed, embodiments of the present invention identify new approaches for using tablet computers with gaming terminals. Advantageously, the popularity of tablet computers further attracts players to such embodiments.

Tablet computers typically receive user inputs via a touch display. Accordingly, in embodiments employing tablet computers, the peripheral device display 212 can also receive input from the player. As shown in FIG. 4C, the wagering game application 434 on the peripheral device 210 presents an application screen 250 with touch icons for each of the features/tools of the application 434.

Figure 6:
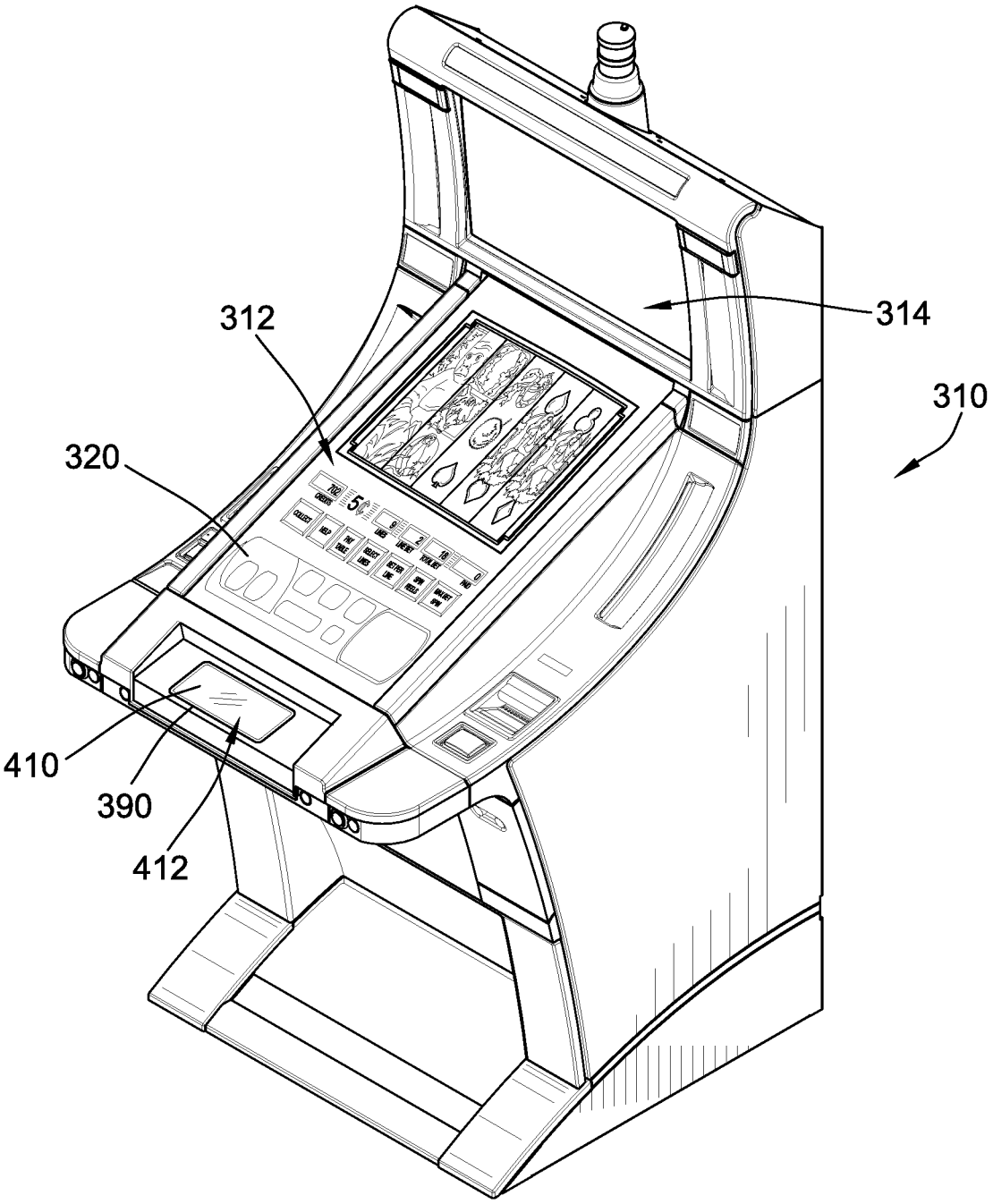
FIG. 6 illustrates another example gaming terminal that includes a docking interface for receiving and communicating with a peripheral device, according to aspects of the present invention.
Figure 7:
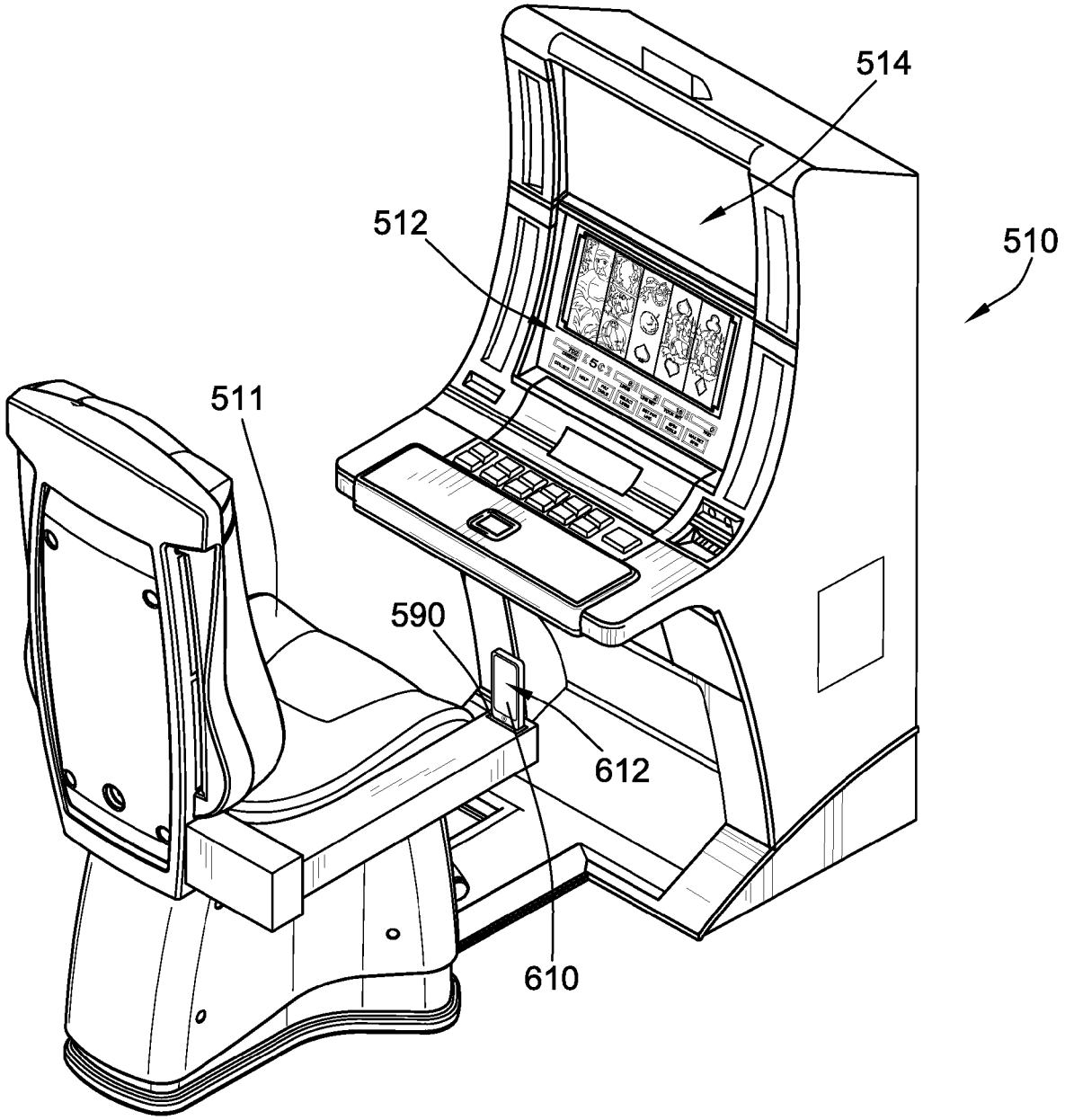
FIG. 7 illustrates yet another example gaming terminal that includes a docking interface for receiving and communicating with a peripheral device, according to aspects of the present invention.

Although FIGS. 4A-C may illustrate an embodiment in which a tablet computer is docked vertically in the gaming terminal 110, FIGS. 6 and 7 show other embodiments that allow selected information to be discretely displayed on a more private display. FIG. 6 illustrates a gaming terminal 310 that is similar in many respects to the gaming terminal 10 shown in FIG. 1. However, the gaming terminal 310 allows a peripheral device 410 similar to a smart phone to be received in a recessed docking interface 390 in a substantially horizontal panel along the front of the gaming terminal 310. The peripheral device 410 is positioned closer to the player standing in front of the gaming terminal 310. As such, the player's body helps to block others from easily viewing the display 412 of the peripheral device 410. As FIG. 6 illustrates, the display 412 is smaller than the primary display 312 or the secondary display 314 of the gaming terminal 310. In general, the size, position, and orientation of the display 412 allow the display 412 to communicate information to the player more discretely than the primary display 312 or the secondary display 314. Like the peripheral device 210 described above, the peripheral device 410 can display selected information relating to the wagering game. In particular, the display 412 may discretely display credit information, wager information, award information, monetary information, and/or player information. The peripheral device 410 may also provide any combination of the features and tools of the wagering game application 234 described above. For example, the position of the peripheral device 410 proximate to the input devices 320 on the gaming terminal 310 allows the peripheral device 410 to provide controls that can be combined with the input devices 320 to control aspects of the gaming terminal 310 and the wagering game.

FIG. 7 also illustrates a gaming terminal 510 that provides many of the features of the gaming terminal 10 shown in FIG. 1. However, the gaming terminal 510 allows the player to be seated in a chair 511 while operating the gaming terminal 510. The chair 511 may provide additional features such as enhanced audio feedback (e.g., via surround sound speakers) and tactile feedback (e.g., via vibration or movement of the chair). In addition, the gaming terminal 510 allows a peripheral device 610 similar to a smart phone to be received in a docking interface 590 positioned near the player, e.g., on an armrest of the chair 511. The peripheral device 610 is positioned closer to the player than a primary display 512 and a secondary display 514 of the gaming terminal 510. As such, the peripheral device 610 is less easily viewed than the other displays 512 and 514. In alternative embodiments, the peripheral device 610 may be received in a swiveling and/or otherwise adjustable docking interface that allows the player to minimize visibility of information displayed by the peripheral device 610 to others.

As FIG. 7 illustrates, the peripheral device 610 includes a display 612 that is smaller than the displays 512 and 514. In general, the size, position, and orientation of the display 612 allows the display 312 to communicate information to the player more discretely than the displays 512 and displays 514. Like the peripheral device 210 described above, the peripheral device 610 can display selected information relating to the wagering game. In particular, the display 612 may discretely display credit information, wager information, award information, monetary information, and/or player information. The peripheral device 610 may also provide any combination of the features and tools of the wagering game application 234 described above. In addition, peripheral device 610 may also provide a tool to customize features of the chair 511 so that feedback from the chair (audio, tactile, etc.) is also more discrete. Indeed, the speakers on the chair 511 may also be configured to provide directional and more discrete audio communications to the player. For example, speakers may be positioned proximate to the player's ears when the player is seated in the chair 511, and such speakers may be employed to discretely communicate (e.g., whisper) information to the player.

Although the gaming terminals of FIGS. 4A-4C, 6, and 7 may employ a docking interface to physically receive a peripheral device, other embodiments may employ alternative or additional approaches to establish communications between the gaming terminal and the peripheral device. In some embodiments, the gaming terminal and the peripheral device may be coupled by a cable that extends from the gaming terminal. In other embodiments, the gaming terminal may provide wireless communications between the gaming terminal and the peripheral device. For example, short range high frequency wireless communication, such as near-field communication (NFC) or BLUETOOTH®, may be employed to provide secure communications. In such embodiments, the login feature on the wagering game application may be employed to establish the secure wireless communication.

For example, the gaming terminal may be provided with a unique identification (e.g., a BLUETOOTH® pairing ID), which can be used to pair the peripheral device with the gaming terminal. In some embodiments, secure communications can be further established by requiring a passkey to be exchanged between the peripheral device and the gaming terminal (in a manner similar to the way a BLUETOOTH® device (e.g., headset) is paired with a handheld device). For additional security, communications (e.g., using the BLUETOOTH® wireless data exchange standard) can be further limited to particular handheld devices, i.e., pairing with other devices such as laptops, printer, etc. can be disabled. The secure wireless communication allows the player to cash out through the peripheral device, transfer money, etc., as described above.

In embodiments without a docking interface may include a resting place (e.g., a recess) for the peripheral device. In particular, the resting place may position the peripheral device so that its display is oriented for discrete communication of communication to the player.

Furthermore, although the embodiments of FIGS. 4A-4C, 6, and 7 may employ a docking interface to establish communications between a gaming terminal and a separate peripheral device, aspects of the present invention may be achieved by providing a gaming terminal with an additional integrated display. Rather than using the display of a separate peripheral device, such embodiments provide an additional integrated (e.g., third) display to display selected information more discretely than the other displays on the gaming terminal (e.g. displays 112 and 114 in FIGS. 4A-B). Processors on the gaming terminal itself may execute an application similar to the wagering game application 234 described above, but the interface, including a display, for the application resides on the gaming terminal.

For example, although the gaming terminal 310 in FIG. 6 allows the separate peripheral device 410 to be received in a recessed docking interface 390, alternative embodiments may integrate a display in the location of the peripheral device 410. Like the peripheral device 410, the integrated display is positioned closer to the player standing in front of the gaming terminal. As such, the player's body helps to block others from easily viewing the integrated display. The integrated display is smaller than the primary display or the secondary display of the gaming terminal. In general, the size, position, and orientation of the integrated display allow the integrated display to communicate information to the player more discretely than the primary display or the secondary display. Like the peripheral device 410, the integrated display can display selected information relating to the wagering game. In particular, the integrated display may discretely display credit information, wager information, award information, monetary information, and/or player information. The integrated display may also provide any combination of the features and tools of the wagering game application 234 described above.

Embodiments with an integrated display device allow players without a separate peripheral device to enjoy the features described above. In other embodiments, the gaming terminal may be provided with a display device that is tethered to the gaming terminal and that operates in a manner similar to the peripheral devices described above.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects, regardless of the embodiments referenced in the description of the elements and aspects.

What is claimed is:

1. A wagering game system, comprising:

a peripheral device including a peripheral device display and at least one processor configured to execute at least one application to display information on the peripheral device display; and a wagering game terminal including a terminal display configured to display a wagering game and a player-accessible interface configured to allow a player to communicatively couple the peripheral device to the wagering game terminal, wherein the at least one application includes a wagering game application relating to the wagering game displayed on the terminal display of the wagering game terminal, and the at least one processor of the peripheral device executes the wagering application to display, on the peripheral device display, wagering game information relating to the wagering game, and wherein the at least one processor of the peripheral device executes the wagering game application to display, on the peripheral device display, at least one of credit information, wager information, award information, monetary information, and player information, the at least one of credit information, wager information, award information, monetary information, and player information being restricted to being displayed on the peripheral device display.

2. The wagering game system of claim 1, wherein the peripheral device includes an input interface configured to receive instructions from the player to customize the wagering game.

3. The wagering game system of claim 2, wherein, in response to the instructions, the at least one processor of the peripheral device executes the wagering game application to display, on the peripheral device display, at least one of credit information, award information, monetary information, and player information.

4. The wagering game system of claim 1, wherein the wagering game application includes a player's account application, and the at least one processor of the peripheral device executes the player's account application to log the player into the wagering game terminal under a player's account.

5. The wagering game system of claim 1, wherein the wagering game application includes a player's account application, and the at least one processor of the peripheral device executes the player's account application to store and display information relating to another wagering game that provides an award based on a plurality of outcomes from one or more wagering games.

6. The wagering game system of claim 1, wherein the wagering game application includes a money transfer application that is electronically coupled to a monetary account, and the at least one processor of the peripheral device executes the money transfer application to transfer money between the wagering game terminal and the monetary account, the wagering game terminal receiving portions of the money from the player for wagers for the wagering game or awarding other portions of the money to the player for outcomes of the wagering game.

7. The wagering game system of claim 1, wherein the peripheral device further includes at least one of a tactile output device and an audio output device, and the at least one processor of the peripheral device executes the wagering application to further provide the wagering game information via at least one of the tactile output device and the audio output device.

8. The wagering game system of claim 1, wherein the interface is a docking station that is configured to receive the peripheral device and establish communications between the peripheral device and the wagering game terminal.

9. The wagering game system of claim 8, wherein the peripheral device, when received by the docking station, provides a secondary display for the wagering game at the bottom of the terminal display.

10. The wagering game system of claim 1, wherein the interface is a wireless interface.

11. The wagering game system of claim 1, wherein the terminal display and the peripheral device display combine to display the wagering game.

12. A wagering game terminal, comprising:

a terminal display configured to display a wagering game; and a player-accessible interface configured to allow a player to communicatively couple a peripheral device to the wagering game terminal, the peripheral device including a peripheral device display and at least one processor configured to execute a wagering game application relating to the wagering game and to display, on the peripheral device display, wagering game information relating to the wagering game, the wagering game information including private information and non-private information, the private information including at least one of credit information, wager information, award information, monetary information, or player information, wherein, in response to the execution of the wagering game application on the peripheral device, the terminal display displays the wagering game in combination with the peripheral device displaying the wagering game information, the private information being restricted to display on only the peripheral device display.

13. The wagering game terminal of claim 12, wherein the at least one of credit information, wager information, award information, monetary information, and player information is classified as private information in response to player selection.

14. The wagering game terminal of claim 12, wherein the peripheral device includes an input interface configured to receive instructions from the player to customize the wagering game, and the terminal display displays the wagering game according to the instructions.

15. The wagering game terminal of claim 14, wherein, in response to the instructions, the terminal display is restricted from displaying at least one of credit information, award information, monetary information, and player information.

16. The wagering game terminal of claim 12, wherein the wagering game application includes a player's account application, and the at least one processor of the peripheral device executes the player's account application to log the player into the wagering game terminal under a player's account.

17. The wagering game terminal of claim 12, wherein the wagering game application includes a money transfer application that is electronically coupled to a monetary account, and the at least one processor of the peripheral device executes the money transfer application to transfer money between the wagering game terminal and the monetary account, the wagering game terminal receiving portions of the money from the player for wagers for the wagering game or awarding other portions of the money to the player for outcomes of the wagering game.

18. The wagering game terminal of claim 12, wherein the peripheral device further includes at least one of a tactile output device and an audio output device, and the at least one processor of the peripheral device executes the wagering application to further provide the wagering game information via at least one of the tactile output device and the audio output device, the terminal display displaying the wagering game to correspond with the peripheral device further providing the wagering game information via at least one of the tactile output device and the audio output device.

19. The wagering game terminal of claim 12, wherein the interface is a docking station that is configured to receive the peripheral device and establish communications between the peripheral device and the wagering game terminal.

20. The wagering game system of claim 19, wherein the peripheral device, when received by the docking station, provides a secondary display for the wagering game at the bottom of the terminal display.

21. The wagering game system of claim 12, wherein the interface is a wireless interface.

* * * * *